US009413111B2

(12) United States Patent
Zhong et al.

(10) Patent No.: US 9,413,111 B2
(45) Date of Patent: Aug. 9, 2016

(54) ELECTRICAL CONNECTOR ASSEMBLY HAVING FOOLPROOF STRUCTURE

(71) Applicant: HON HAI PRECISION INDUSTRY CO., LTD., New Taipei (TW)

(72) Inventors: Wei Zhong, Kunshan (CN); Qiu Qian, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 145 days.

(21) Appl. No.: 14/287,072

(22) Filed: May 26, 2014

(65) Prior Publication Data

US 2014/0349507 A1 Nov. 27, 2014

(30) Foreign Application Priority Data

May 24, 2013 (CN) ..... 2013 2 0289423 U

(51) Int. Cl.

| | |
|---|---|
| ***H01R 4/50*** | (2006.01) |
| ***H01R 13/625*** | (2006.01) |
| ***H01R 13/64*** | (2006.01) |
| *H01R 12/73* | (2011.01) |
| *H01R 13/6582* | (2011.01) |

(52) U.S. Cl.

CPC ..... *H01R 13/64* (2013.01); *H01R 12/732* (2013.01); *H01R 13/6582* (2013.01)

(58) Field of Classification Search

CPC ... H01R 13/639; H01R 13/64; H01R 23/6873

USPC ..... 439/347, 680, 607.32, 607.4

See application file for complete search history.

(56) References Cited

U.S. PATENT DOCUMENTS

| | | | | |
|---|---|---|---|---|
| 5,055,069 | A * | 10/1991 | Townsend | H01R 23/688 439/607.11 |
| 5,267,881 | A * | 12/1993 | Matuzaki | H01R 24/62 439/660 |
| 6,358,089 | B1 * | 3/2002 | Kuroda | H01R 12/716 439/607.13 |
| 7,303,438 | B2 * | 12/2007 | Dawiedczyk | H01R 12/7005 439/358 |
| 7,364,464 | B2 * | 4/2008 | Iino | H01R 12/716 439/607.55 |
| 7,429,197 | B2 * | 9/2008 | Weis | H01R 9/03 439/374 |
| 7,686,659 | B2 * | 3/2010 | Peng | H01R 12/725 439/660 |
| RE41,224 | E | 4/2010 | Kubota et al. | |
| 7,922,536 | B2 * | 4/2011 | Zhang | H01R 13/6583 439/607.45 |
| 8,961,235 | B2 * | 2/2015 | Little | H01R 13/64 439/374 |

FOREIGN PATENT DOCUMENTS

| | | |
|---|---|---|
| TW | 446213 | 7/2001 |

* cited by examiner

*Primary Examiner* — Hae Moon Hyeon

(74) *Attorney, Agent, or Firm* — Wei Te Chung; Ming Chieh Chang

(57) ABSTRACT

An electrical connector assembly includes a first connector and a second connector mating with the first connector in a mating direction. The first connector includes a mating portion defining two long walls opposite to each other and two short walls disposed oppositely, the long and short walls are connected to each other together to form a mating cavity. The second connector includes a mating tongue extending forwardly and a second shielding shell defining a mating frame surrounding the mating tongue. Wherein one of the long walls defines a pair of fool-proof portions extending outwardly from both sides thereof, the mating frame defines a pair of fool-proof slots and engaging with the fool-proof portions so as to prevent the first connector from mismating the second connector.

15 Claims, 5 Drawing Sheets

ELECTRICAL CONNECTOR ASSEMBLY HAVING FOOLPROOF STRUCTURE

BACKGROUND OF THE INVENTION

1. Field of the Invention

The present invention relates to an electrical connector assembly, and more particularly to an electrical connector assembly having a fool-proof structure.

2. Description of the Related Art

U.S. Pat. No. RE41,224 issued on Apr. 13, 2010 discloses an electrical connector, the electrical connector includes a insulative housing, a plurality of conductive terminals retained in the insulative housing and a shielding shell assembled to the insulative housing. The insulative housing defines two long walls opposite to each other and two opposite short walls, at least one long wall defines a pair of fool-proof portions projecting into a mating space from the long wall. Due to the fool-proof portions projected from the surface of the long wall of the insulative housing, it will damage the mating connector when the fool-proof portions of the electrical connector are excessive inserted into a mating cavity of a mating connector. Meanwhile, the fool-proof portions need to occupy a certain space of the mating connector, which is not conducive to the miniaturization trend of the electrical connector.

Therefore, an improved electrical connector assembly is highly desired to meet overcome the requirement.

BRIEF SUMMARY OF THE INVENTION

An object of the present invention is to provide an electrical connector assembly having anti-misinsertion function, the electrical connector assembly can prevent a first connector from inserting into a mismatch electrical connector.

In order to achieve above-mentioned object, an electrical connector assembly includes a first connector and a second connector mating with the first connector in a mating direction. The first connector includes a mating portion defining two long walls opposite to each other and two short walls disposed oppositely, the long and short walls are connected to each other together to form a mating cavity. The second connector includes a mating tongue extending forwardly and a second shielding shell defining a mating frame surrounding the mating tongue. Wherein one of the long walls defines a pair of fool-proof portions extending outwardly from both sides thereof, the mating frame defines a pair of fool-proof slots and engaging with the fool-proof portions so as to prevent the first connector from mismating the second connector.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
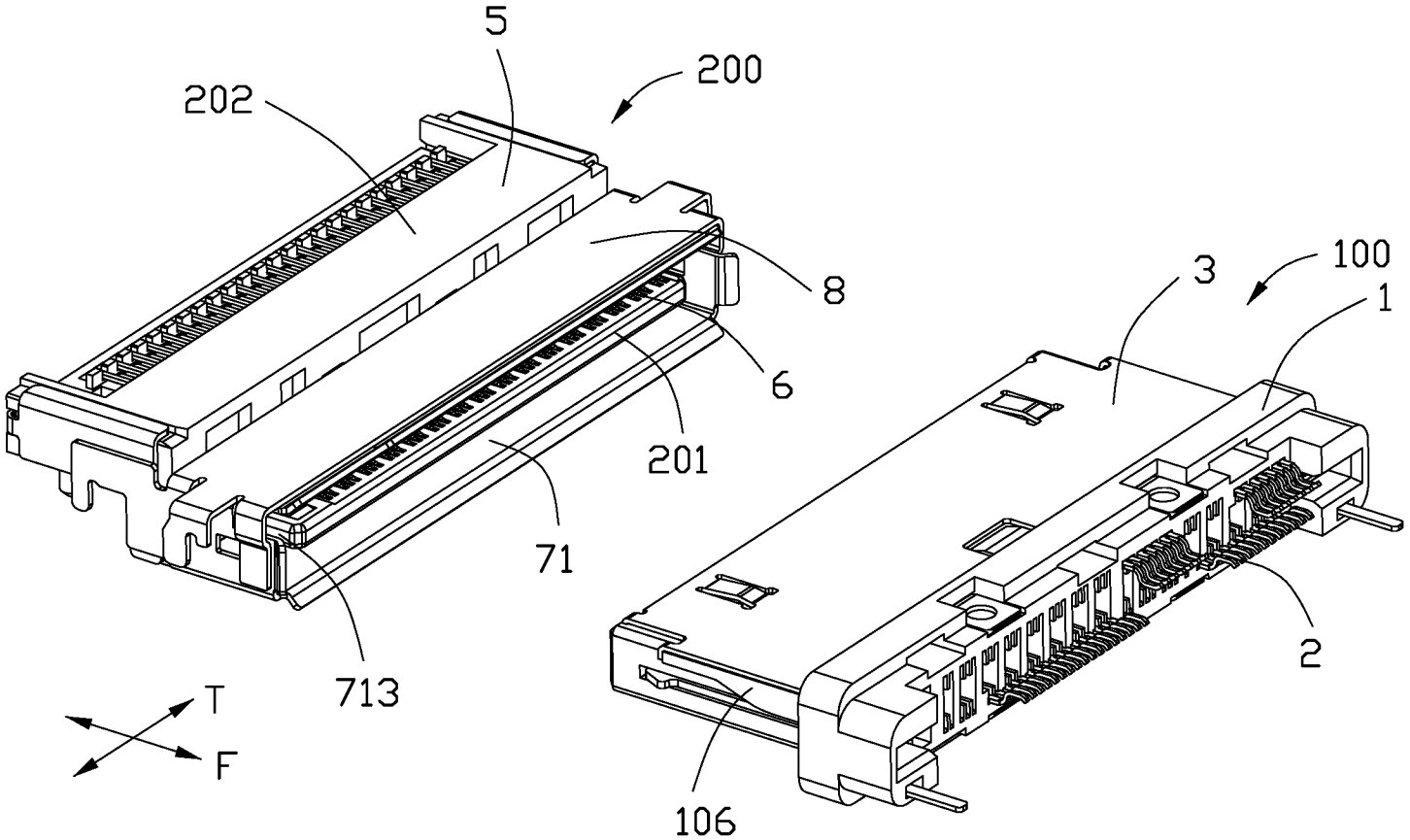
FIG. 1 is a perspective view of an electrical connector assembly in accordance with the present invention, a first and a second connectors of the electrical connector assembly are not matched.

Reference will now be made to the drawing figures to describe a preferred embodiment of the present invention in detail. Referring to FIG. 1 to FIG. 4, an electrical connector assembly in accordance with the present invention includes a first connector 100 and a second connector 200 mating with each other.

The first connector 100 includes a first insulative housing 1, a plurality of first terminals 2 inserted in the first insulative housing 1 and a first shielding shell 3. The second connector 200 includes a second insulative housing 5, a plurality of second terminals 6 retained in the first insulative housing 5 and a second shielding shell 7.

The first connector 100 includes a mating portion 11 and a mounting portion 12, the mating portion 11 defines two long walls 103 opposite to each other and two short walls 104 disposed oppositely, the long walls 103 and the short walls 104 are connected to each other to form a mating cavity or slot 101. The long wall 103 extends in a transverse direction, and the mating cavity 101 communicates forwardly with an exterior in a front-to-back direction perpendicular to the transverse direction. One long wall 103 of the first connector 100 defines a pair of fool-proof portions 106 extending outwardly from the opposite sides thereof, which means that the fool-proof portions 106 are flush with the long wall 103. The second connector 200 includes a mating tongue 201 and a mounting portion 202 extending along a mating direction, and the second shielding shell 7 defines a mating frame 71 surround the mating tongue 201, the mating frame 71 defines a pair of corresponding fool-proof slots or ports 713 so that the fool-proof portions 106 inserted along the mating direction and pressed against the fool-proof slots 713. The mating frame 71 of the second shielding shell 7 defines a pair of long walls 711 and a pair of short walls 712 disposed oppositely, the fool-proof slots 713 are respectively located on the corresponding short walls 712 and running through the front edge of the mating frame 71, while the fool-proof slots 713 are adjacent to the one of the long walls 711 which means that the fool-proof slots 713 are flush with the long wall 711. The second connector 200 also includes a metal plate 8 covering one of the long walls 711, the metal plate 8 defines a pair of reinforcing pieces 81 located outside of the fool-proof slots 713. The free end of the reinforcing pieces 81 abut the outside of the short walls 712 and project outwardly from the corresponding fool-proof slots 713. Thus, the reinforcing pieces 81 can form a protection to the fool-proof slots 713 and not interfere with the fool-proof function while it can increase the strength of the mating frame 71.

Figure 2:
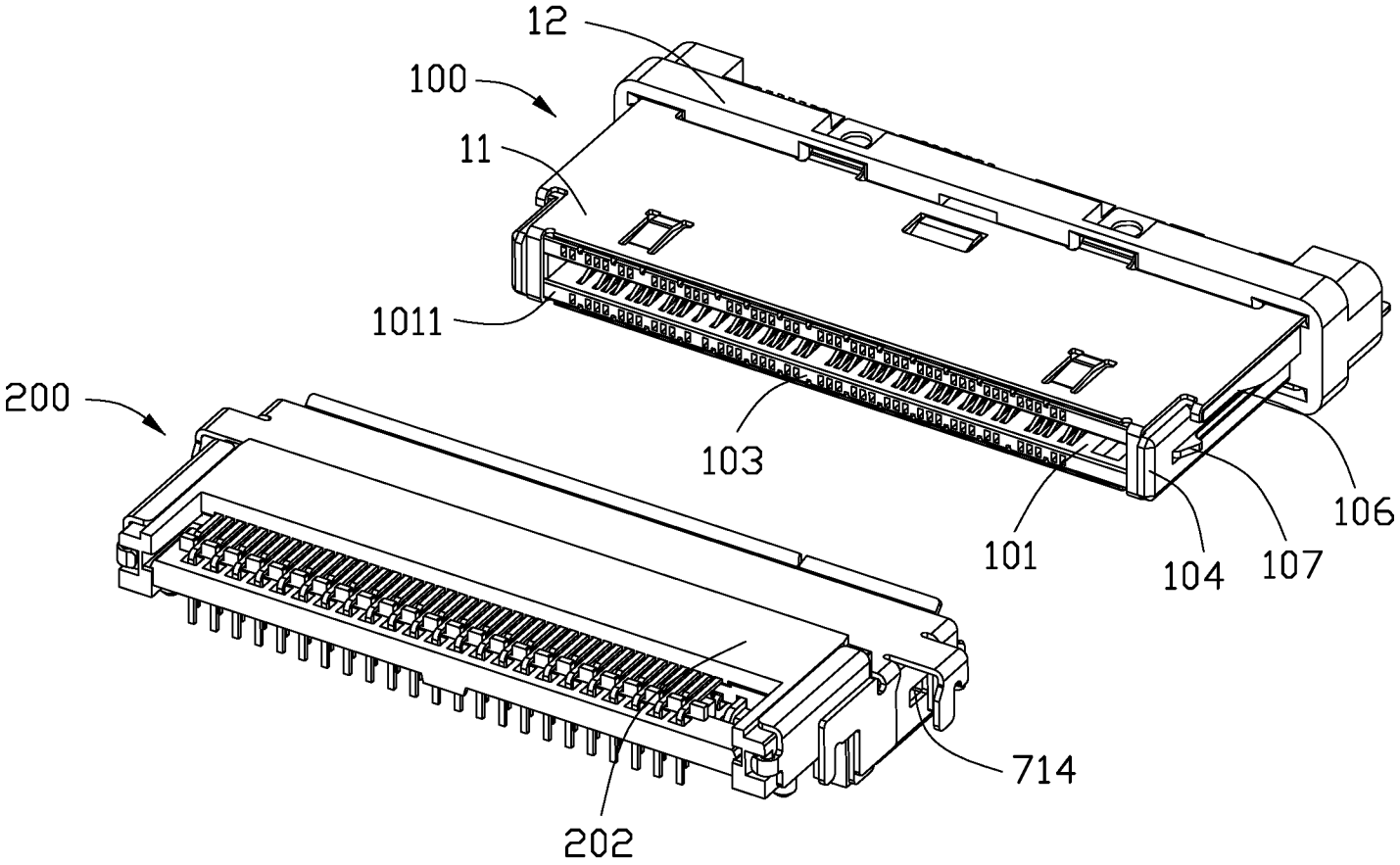
FIG. 2 is another perspective view of the electrical connector assembly shown in FIG. 1.
Figure 5:
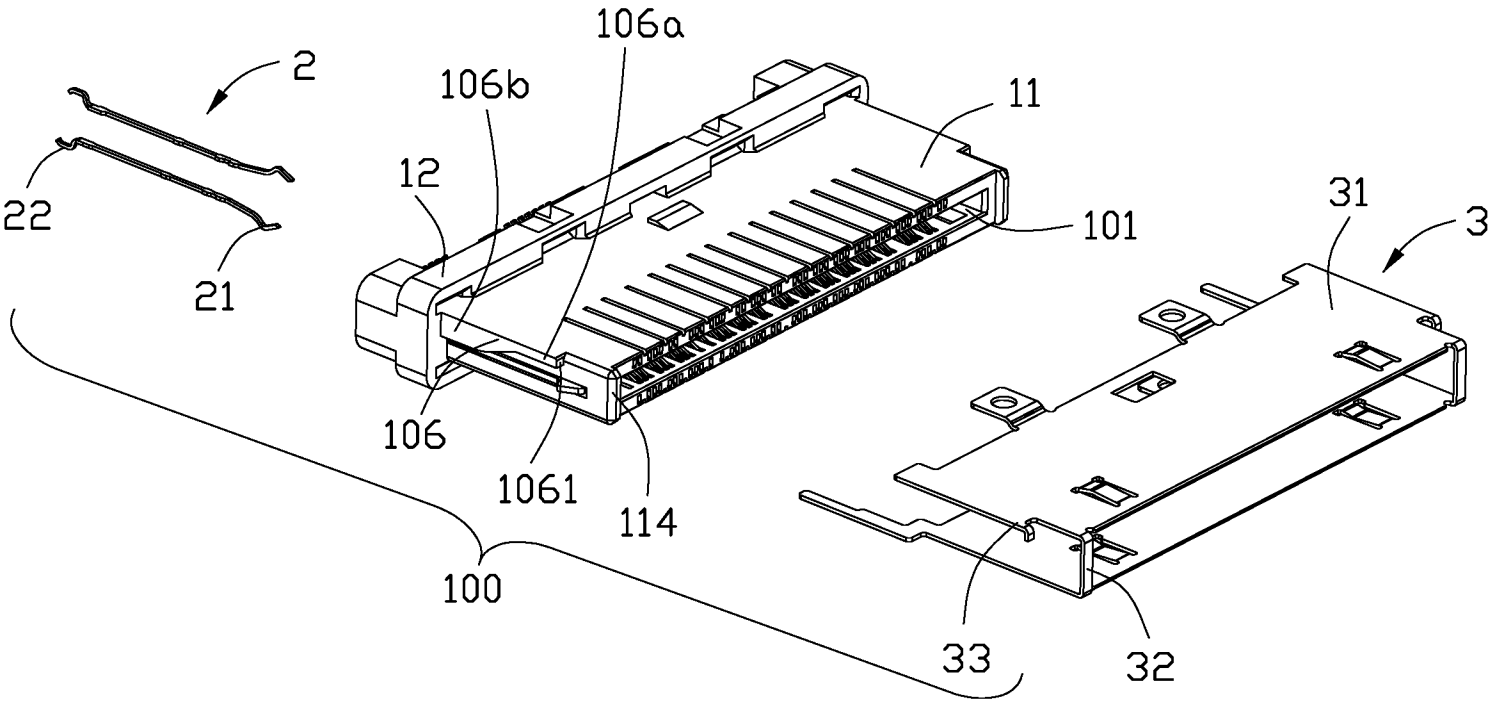
FIG. 5 is a partly exploded perspective view of the first connector of the electrical connector assembly.

Referring to FIG. 2 and FIG. 5, the fool-proof portion 106 has a thinner/narrow front portion **106*a* inserted in the fool-proof slots 713 and a thicker/wide rear portion 106*b*. The mating portion 11 of the first connector defines a mating face 1011 and a pair of locking members 107 located on two short walls 104 with corresponding locking heads protruding laterally out of the corresponding short walls 104, a front surface 1061 of the fool-proof portion 106 is located in the rear side of the mating face 1011 and also located in the rear side of the locking members 107. Each short wall 712 defines a locking hole 714, the fool-proof slot 713 is located between the locking hole 714 and the long wall 711 adjacent to the fool-proof slot 713. The fool-proof slot 713 is not exceed rearward the locking hole 714 and located on the front portion of the mating frame 71**.

Figure 4:
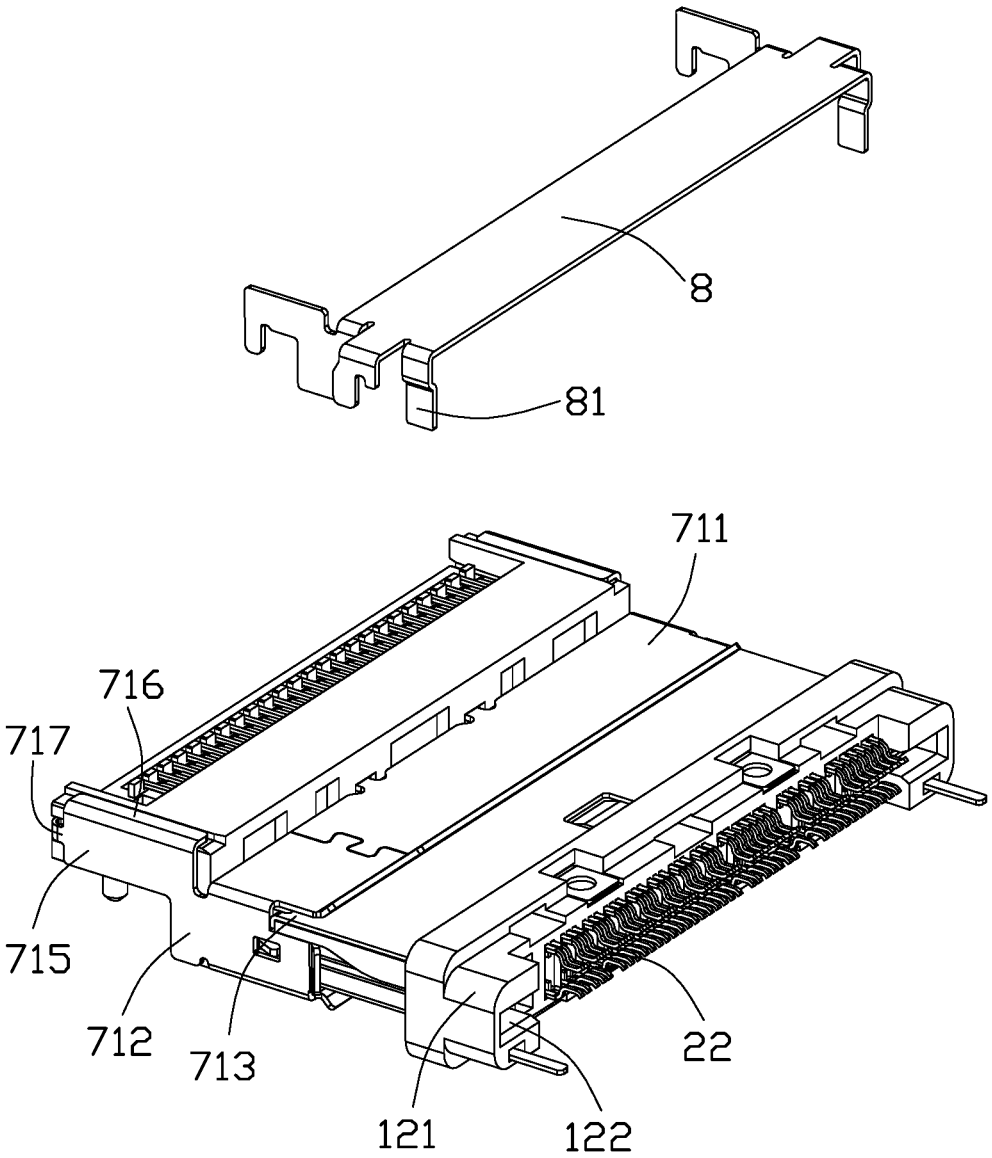
FIG. 4 is a partly exploded perspective view of the electrical connector assembly shown in FIG. 3.

The first insulative housing 1 of the first connector 100 includes a mating portion 11 and a mounting portion 12 integrally formed. The conductive terminals 2 are retained in the inner surfaces of the two long walls of the mating portion 11 and each defines a contacting portion 21 projecting into the mating cavity 101 and a soldering portion 22 extending outside of the rear surface 108 of the mounting portion 102. Referring to FIG. 4, the rear surface 108 of the mounting portion 102 defines a pair of supporting portions 121 extending rearwardly and located on opposite sides of the soldering portions 22, each supporting portion 121 defines a mounting slot 122 recessing to the rear surface 108, a printed circuit board (PCB, not shown) extends into the mounting slots 122 along the mating direction. The soldering portions 22 are located on the upper and lower sides of the mounting slots 122 and welded to the upper and lower sides of the printed circuit board so as to form a printed circuit board (PCB) sink-style connection, which can reduce the space of the electrical connector in a height direction.

The mating port (not labeled) of the first connector 100 includes the mating portion 11 and the first shielding shell 3, the first shielding shell 3 defines two base portions 31 attached to two corresponding long walls of the mating portion 11 and two connecting portions 32 connecting with the base portions 31. The connecting portions 32 are located on two front sides of the base portions 31, respectively. A pair of extending portions 33 are located on both edges of one of the base portions 31 and extend beyond the connecting portions 32, the extending portions 33 is attached to the fool-proof portion 106 and covering the front surface 1061 of the fool-proof portion 106. The short wall of mating portion 11 defines a projecting portion 114 extending forwardly, the two connecting portion 32 are abutting the mating face 1011 and adjacent to the projecting portion 114. The locking member 107 extends from the rear surface 108 of the mounting portion 12 and projecting outside of the short wall 104, the fool-proof portion 106 is located above the locking member 107 and the front surface of the fool-proof portion 106 is not exceeded the front of the locking member 107.

Figure 3:
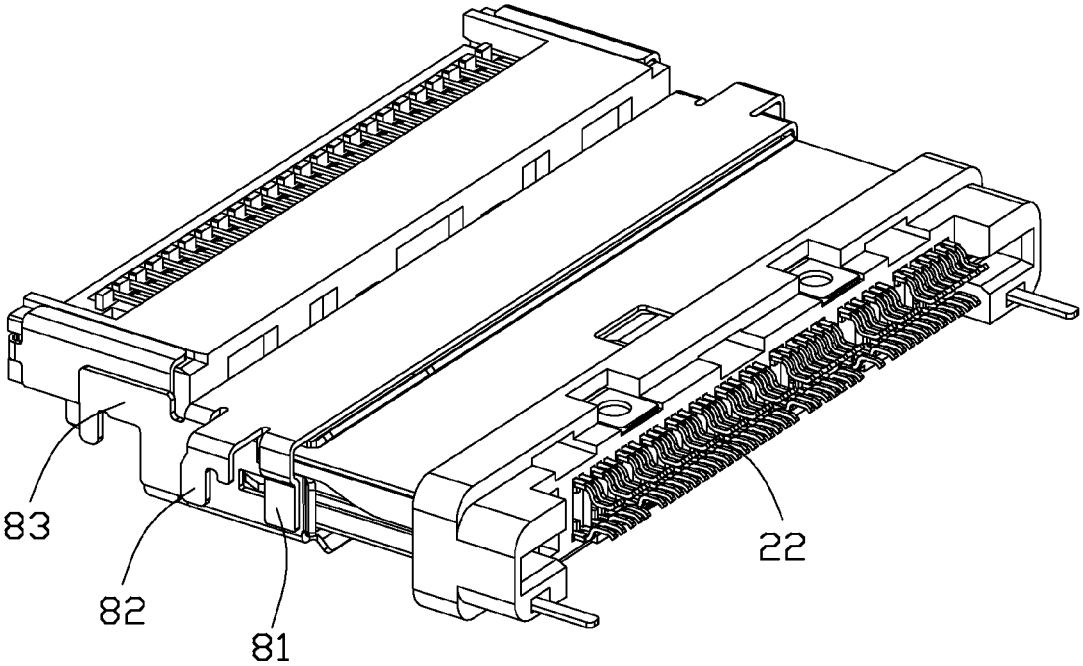
FIG. 3 is an perspective view of the electrical connector assembly, the first and second connectors of the electrical connector assembly are matched.

Referring to FIG. 3 and FIG. 4, each short wall 712 of the second shielding shell 7 further defines a flank 715 extending rearwardly, the flank 715 defines a holding portion 716 bending to the top of the mounting portion 202 and a stopping portion 717 bending to the rear side of the mounting portion 202. The holding portion 716 is used to limit the movement of the second shielding shell 7 in the vertical direction. The metal plate 8 defines a pair of soldering feet 82 extending outwardly and bending downwardly and a pair of clamping portion 83 extending from the rear side of the soldering feet 82. The soldering foot 82 is located on outside of the reinforcing piece 81 and perforated welding so as to match the sink-type second connector 200, the clamping portion 83 is clamping the outside of the flank 715. In best embodiment, the metal plate 8 is fixed to the second shielding shell 7 by spot welding.

The front surface 1061 of the fool-proof portion 106 of the first connector 100 is located in the rear side of the front surface of the mating portion 11 so that the mating portion 11 has a fool-proof function and is easy to be inserted into the mating frame 71 of the second connector 200. Because of the front portion of the fool-proof portion 106 thinner, the fool-proof port 713 of the second connector 200 corresponding to the fool-proof portion 106 can be smaller and will have less influence to the strength of the short walls of the mating frame 71. While the rear portion of the fool-proof portion 106 is thicker so as to ensure the strength of the fool-proof portion 106.

When the first connector 100 engaged with the second connector 200, the thinner front portion of the fool-proof portion 106 is inserted into the fool-proof port 713 in the mating direction, and the extending portion 33 covering the front portion of the fool-proof portion 106 is pressed against the fool-proof port 713 in the mating direction. That is, if the second connector 200 has no a fool-proof port 713, the fool-proof portion 106 will abut the short wall 712 of the mating frame 71 directly so that the second connector can not engage with the first connector 100 in order to achieve the fool-proof function. The extending portion 33 is metal material and electrically contacting the second shielding shell 7 which is conducive to the shielding effect of the electrical connector assembly. The locking member 107 is inserted in the mating frame 71 and projecting outside of the locking hole 714 in order to ensure reliability connection between the first and second connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector assembly, comprising:

a first connector comprising:

a mating portion defining two long walls opposite to each other and two short walls disposed oppositely, the long walls and the short walls connected to each other together to form a mating cavity;

a metallic first shielding shell enclosing the mating portion;

a second connector mating with the first connector in a mating direction and comprising:

a mating tongue extending forwardly;

a metallic second shielding shell defining a mating frame surrounding the mating tongue; wherein one of the long walls defines a pair of fool-proof portions extending outwardly from both sides thereof, the mating frame defines a pair of fool-proof slots and engaging with the fool-proof portions so as to prevent the first connector from mismating the second connector; wherein the fool-proof portion has a thinner front portion and a thicker rear portion, the front portion is at least partly inserted in the fool-proof slot.

2. The electrical connector assembly as described in claim 1, wherein the mating portion of the first connector defines a mating face, a front surface of the fool-proof portion is located on the rear side of the mating surface.

3. The electrical connector assembly as described in claim 2, wherein each short wall of the mating portion defines a locking member, and the front surface is located on the rear side of the locking member.

4. The electrical connector assembly as described in claim 1, wherein the first connector defines a first shielding shell covering the outside of the two long walls, and the first shielding shell defines a pair of extending portions covering the fool-proof portions.

5. The electrical connector assembly as described in claim 4, wherein each of the extending portions shields a front face of the fool-proof portion.

6. The electrical connector assembly as described in claim 1, wherein the first connector further defines a plurality of conductive terminals retained in the two long walls of the mating portion and a mounting portion defining a pair of mounting slots, the conductive terminals define soldering portions extending outside of the mounting portion and located on the upper and lower sides of the mounting slots respectively.

7. The electrical connector assembly as described in claim 1, wherein the second connector further defines a metal plate positioned upon the second shielding shell, the metal plate defines a pair of reinforcing pieces located on the outside of the fool-proof slot and each reinforcing piece is pressed against the mating frame and projecting outwardly from the corresponding fool-proof slot.

8. An electrical connector comprising:

an insulative housing defining a mating portion and a mating tongue;

a plurality of terminal retained in the insulative housing; and a metallic shielding shell defining a mating frame surrounding the mating tongue, the mating frame defining a pair of long walls and a pair of short walls connected to each other and disposed oppositely;

wherein each short wall defines a fool-proof slot running through the front edge of the mating frame, and the fool-proof slot is adjacent to one of the long walls and extends through the corresponding short wall in a transverse direction; wherein each short wall defines a locking hole, and the fool-proof slot is located between the locking hole and said one of the long walls and does not extend forwardly beyond the locking hole.

9. The electrical connector as described in claim 8, wherein the fool-proof slot is located at front side of the short wall.

10. The electrical connector as described in claim 8, wherein the connector further defines a metal plate covering said shielding shell, the metal plate defines a pair of reinforcing pieces located on the outside of the fool-proof slot and each reinforcing piece presses against the short wall and projects outwardly from the corresponding fool-proof slot to cover said fool-proof in said transverse direction.

11. The electrical connector as described in claim 10, wherein each short wall defines a locking hole which is located behind the corresponding reinforcing piece in a front-to-back direction and exposed to an exterior in said transverse direction.

12. An electrical connector assembly comprising:

an insulative housing defining a horizontal mating cavity commonly surrounded by opposite top and bottom walls and a pair of opposite side walls;

a pair of fool-proof protrusions extending, in a transverse direction, outwardly opposite to each other on two opposite corners of either said top wall or said bottom wall and the corresponding side walls, respectively;

a pair of deflectable latches disposed upon the corresponding side walls, respectively, with corresponding locking heads exposed to an exterior in the transverse direction; wherein each of said fool-proof protrusions is terminated behind a front edge of the housing in a front-to-back direction perpendicular to said transverse direction.

13. The electrical connector assembly as claimed in claim 12, wherein each of said fool-proof protrusions is terminated not to exceed beyond the locking head of the corresponding latch.

14. The electrical connector assembly as claimed in claim 12, further including a metallic shell covering said one of the top and bottom walls and said pair of fool-proof protrusions in a vertical direction perpendicular to both said transverse direction and said front-to-back direction.

15. The electrical connector assembly as claimed in claim 12, wherein each of said fool-proof protrusions defines a narrow front portion and a wide rear portion in the front-to-back direction, and only the narrow front narrower is configured to be inserted into a corresponding fool-proof slot in a complementary connector.

* * * * *